US011353826B2

(12) United States Patent
Karapatis et al.

(10) Patent No.: US 11,353,826 B2
(45) Date of Patent: Jun. 7, 2022

(54) VERTICAL CLUTCH DEVICE FOR A TIMEPIECE

(71) Applicant: Montres Breguet S.A., L'Abbaye (CH)

(72) Inventors: Polychronis Nakis Karapatis, Premier (CH); Marc Stranczl, Nyon (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 17/173,626

(22) Filed: Feb. 11, 2021

(65) Prior Publication Data

US 2021/0271205 A1 Sep. 2, 2021

(30) Foreign Application Priority Data

Feb. 21, 2020 (EP) ..... 20158703

(51) Int. Cl.
*G04B 11/00* (2006.01)

(52) U.S. Cl.
CPC ..... *G04B 11/003* (2013.01)

(58) Field of Classification Search
CPC ..... G04B 11/00; G04B 11/001; G04B 11/003
See application file for complete search history.

(56) References Cited

U.S. PATENT DOCUMENTS 5,982,521 A 11/1999 Bessho et al.
9,978,548 B2 * 5/2018 Rohner ..... H01H 29/18
2008/0304370 A1 12/2008 Scheufele
2015/0041289 A1 * 2/2015 Ely ..... G04B 27/002 200/4
2015/0241846 A1 * 8/2015 Briswalter ..... G04B 37/103 368/319
2019/0146418 A1 * 5/2019 Junod ..... G04B 37/05 368/297

FOREIGN PATENT DOCUMENTS

CH 708 945 A2 6/2015
CN 101324782 A 12/2008
CN 104769511 7/2015
CN 206301154 7/2017
(Continued)

OTHER PUBLICATIONS

European Search Report dated Aug. 17, 2020, in corresponding application No. EP20158703.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A vertical clutch device for a timepiece includes along a vertical axis a first wheel rotatably mounted about the vertical axis, a clutch disc, a spring, and a second wheel rotatably mounted about the vertical axis. The vertical clutch device is able to assume a clutched position where the second wheel is rotated by the first wheel under the action of the spring exerting a vertical force Fe to press the clutch disc against the first wheel and a disengaged position where the clutch disc is subjected against the action of the spring to a vertical force Fd separating it from the first wheel so that the second wheel is not rotated by the first wheel. The spring of the vertical clutch device is made of a shape memory alloy.

13 Claims, 4 Drawing Sheets

(56) References Cited

FOREIGN PATENT DOCUMENTS

| | | | |
|---|---|---|---|
| CN | 109782566 | | 5/2019 |
| EP | 2085832 | A1 | 8/2009 |
| EP | 3264198 | A1 | 1/2018 |
| JP | H9-230275 | A | 9/1997 |
| JP | 2013-142549 | A | 7/2013 |

OTHER PUBLICATIONS

Office Action dated Feb. 14, 2022 in Chinese Application No. 202110189245.3, along with an English translation.
Notice of the Reason for Refusal dated Feb. 15, 2022 in corresponding Japanese Patent Application No. 2021-011669 (with English translation)(6 pages).

* cited by examiner

VERTICAL CLUTCH DEVICE FOR A TIMEPIECE

CROSS-REFERENCE TO RELATED APPLICATION

The present application claims priority to European Patent Application No. 20158703.7, filed on Feb. 21, 2020, the entire content and disclosure of which are incorporated by reference herein.

FIELD OF THE INVENTION

The present invention relates to a vertical clutch device for a timepiece, more particularly for a chronograph.

BACKGROUND OF THE INVENTION

Disengaging devices are used in the field of watchmaking and in particular for chronographs. In a chronograph, the chronograph wheel that carries the chronograph hand is connected to the seconds wheel via a clutch. The clutch can occupy a clutched position, corresponding to the chronograph operating position, where the chronograph wheel is driven by the seconds wheel, and a disengaged position, corresponding to the chronograph stop position, where the chronograph wheel is not driven by the seconds wheel. The operation of a vertical clutch device 1 within a partially shown chronograph mechanism 8 is illustrated in FIGS. 1*a* and 1*b* for the disengaged position and the clutched position, respectively. The clutch device generally comprises on the same axis a first wheel 3, a second wheel 2 and a clutch disc 4. The first wheel 3 is the driving element which rotates continuously and which is in engaged with the seconds wheel 9. The second wheel 2 is engaged with the chronograph wheel 10. The clutch disc 4 cooperates with a pair of clamps 5, the opening and closing of which is controlled by a column wheel (not shown). Closing the clamps 5 raises the clutch disc 4 against the action of a spring 6 as shown schematically in FIG. 1*a*. In this disengaged position, the clutch disc 4 is not in contact with the first wheel 3 with the corollary that the second wheel 2 is not driven. When opening the clamps 5, the clutch disc 4 is pressed against the first wheel 3 under the action of the spring 6 (FIG. 1*b*). In this clutched position, the first wheel 3 drives the second wheel 2 by friction. So that the friction is sufficient, the clutched force $F_e$ must be high, that is to say that a significant pre-stress must be applied to the spring.

According to the prior art, the springs are made of standard materials such as steel which have elastic behaviour over a few tenths of a percent before entering the plastic range. In operation, the spring must work within its elastic range to avoid any irreversible deformation. In this elastic range, the spring has a linear behaviour with a return force proportional to the displacement. FIG. 2 typically shows the force-displacement curve in the elastic range. The clutched force ($F_e$) is fixed by the pre-stress applied (displacement p) on the spring and the disengaged force ($F_d$) is fixed by the displacement (d) required to separate the clutch disc from the first wheel. In practice, the spring works at the limit of its elastic capacities because it is subjected to a significant pre-stress with a risk of plastic deformation during displacement when disengaged. In addition to the risk of inducing an irreversible deformation of the spring, these large deformations cause premature fatigue of the spring. Moreover, the behaviour of the spring being linear in the elastic range, any increase in the clutched force leads to an increase in the disengaged force which will have to be provided by the clamps.

In the illustrated example, starting with a sufficient clutched force $F_e$ so that the clutch does not slip, namely 0.67 N in the example, the remoteness of the clutch disc from the first wheel by a distance d, equal to 0.1 mm in the example, requires a significant force $F_d$ of 1.5 N to counter the spring return force. Typically, the disengaged force $F_d$ is thus more than two times greater than the clutched force $F_e$.

SUMMARY OF THE INVENTION

The object of the present invention is to provide a clutch device providing a maximised clutched force for a disengaged force which, in turn, is minimised. In other words, the object of the invention is to reduce the ratio between the disengaged force and the clutched force.

To this end, the present invention provides a clutch device comprising a spring made of a shape memory alloy used at room temperature for its superelasticity properties. The spring made of a shape memory alloy has a nonlinear behaviour in the elastic range with a stress which peaks at an almost constant value over a wide range of deformation. These superelasticity properties and nonlinear behaviour allow the disengaged force and the clutched force to be easily adjusted according to the required operating conditions. Thus, a significant pre-stress can be applied to the spring without risk of entering the plastic range when the mechanism is disengaged. As a corollary, the spring is no longer biased to the limit of its elastic capacities unlike the spring of the prior art, which allows premature fatigue of the spring in use to be avoided. Moreover, the disengaged force can be minimised by biasing the spring in the range where the stress, and therefore the force, peaks at an almost constant value.

According to the invention, the spring may be dimensioned to increase the clutched force while maintaining an equivalent disengaged force or conversely be dimensioned to reduce the disengaged force while maintaining an equivalent clutched force. Advantageously, the ratio between the disengaged force and the clutched force is comprised between 1.1 and 2.0.

BRIEF DESCRIPTION OF THE FIGURES

Other features and advantages of the invention will become apparent upon reading the detailed description which follows, with reference to the appended drawings.

DESCRIPTION OF THE INVENTION

Figure 7:
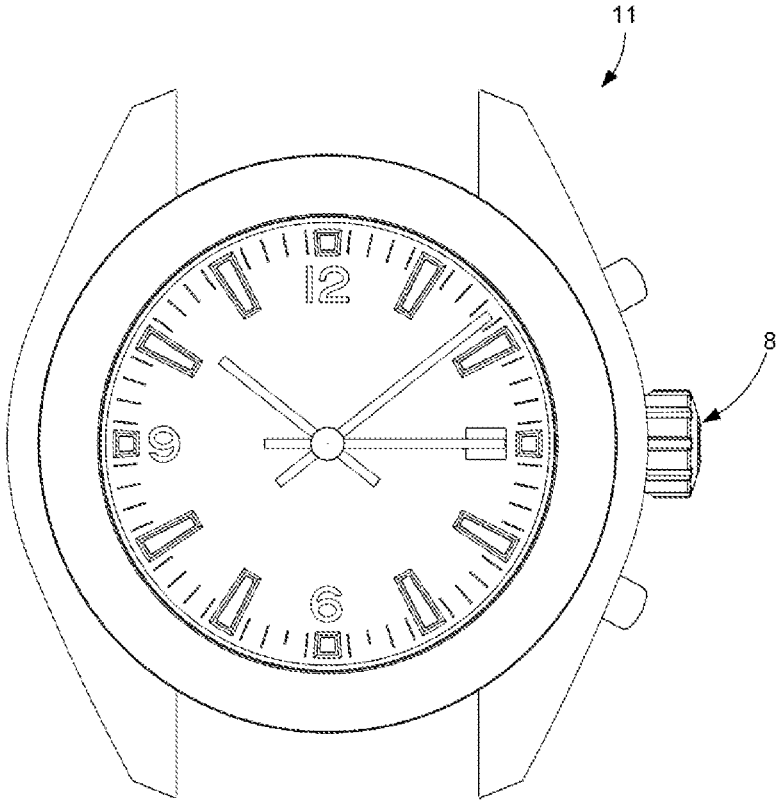
FIG. 7 shows a watch provided with a chronograph mechanism according to the invention.

The invention relates to a clutch device comprising a spring made of a shape memory alloy. It relates more specifically to a clutch device intended to equip a chronograph mechanism 8 with a timepiece 11 (FIG. 7).

Figure 3:
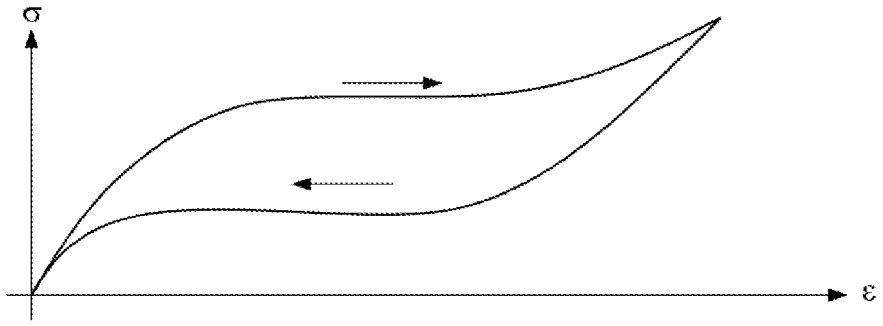
FIG. 3 shows the typical tensile (stress-deformation) curve of a shape memory alloy.

According to the invention, the superelasticity properties of the shape memory alloy are utilised to reduce the difference between the clutched force and the disengaged force. FIG. 3 illustrates the superelastic behaviour of a shape memory alloy which has at room temperature an austenitic structure which transforms into martensite under the application of a stress a, which allows the material to be deformed in a reversible manner by several percent. The tensile curve first has a linear elastic behaviour up to a critical stress where the martensitic transformation induces a superelastic behaviour with increasing deformation under an almost constant stress. This is the plateau seen in FIG. 3. As soon as the stress is released, the reverse transformation from martensite to austenite takes place and the alloy returns to its original dimension. Thus, a spring made of this material allows a stress to be obtained, and therefore a force, according to the displacement which is not proportional but peaks at a certain value on the plateau of the curve unlike a conventional material such as steel.

Preferably, the shape memory alloy according to the invention is a copper-based alloy or a nickel and titanium-based alloy. The copper-based alloy is one of the alloys having, for a total percentage of 100% and a percentage of possible impurities less than or equal to 0.5%, the following composition by weight:

- Cu between 64.5 and 85%, Zn between 9.5 and 25% and Al between 4.5 and 10%,
- Cu between 79.5 and 84%, Al between 12.5 and 14% and Ni between 2.5 and 6%,
- Cu between 87 and 88%, Al between 11 and 12% and Be between 0.3 and 0.7%.

The nickel and titanium-based alloy consists of nickel with a percentage by weight comprised between 52.5 and 63% and titanium with a percentage by weight comprised between 36.5 and 47%, for a total percentage of 100% and a percentage of possible impurities less than or equal to 0.5%.

This alloy has at room temperature, in the absence of stresses, an austenitic microstructure.

Figure 1A:
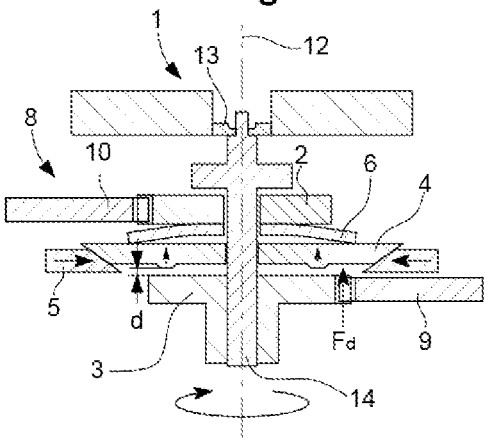
FIGS. 1*a* and 1*b* schematically illustrate the operation of a clutch device with the latter in the disengaged position in FIG. 1*a* and in the clutched position in FIG. 1*b*. These figures relate to the prior art but they are also applicable for a clutch device according to the invention.
Figure 1B:
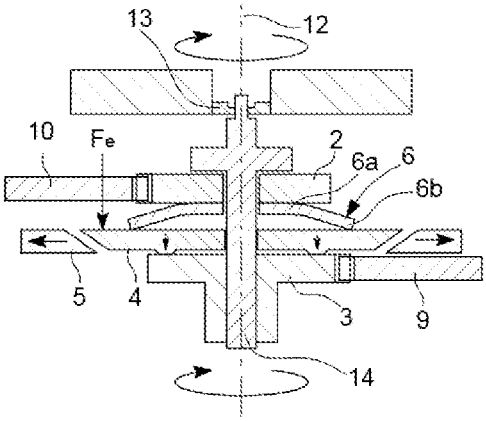
Figure 5A:
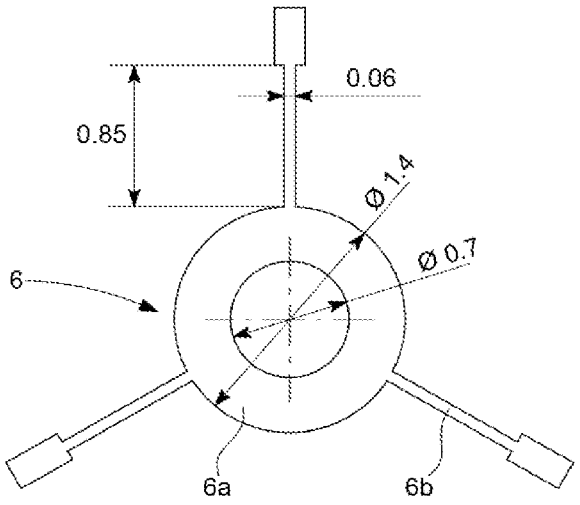
FIG. 5*a* shows the geometry of the spring, according to a variant of the invention, used in the clutch device according to the invention.

Preferably, the spring 6 includes a central annular part 6*a* and several tabs 6*b* starting from said central annular part 6*a* as illustrated in FIG. 5*a*. For example, the number of tabs can be 3. Typically, the thickness of the spring is comprised between 0.05 and 0.4 mm. Preferably, the tabs 6*b* are inclined relative to the plane defined by the central annular part 6*a* as schematically shown in FIGS. 1*a* and 1*b*. Depending on the level of pre-stress applied to the tabs in the clutched position (FIG. 1*b*), the latter are more or less inclined relative to the plane of the annular part.

The spring 6 is arranged within the clutch device 1 as previously described with reference to FIGS. 1*a* and 1*b* with the clutch disc 4, the first wheel 3 and the second wheel 2.

Figure 6:
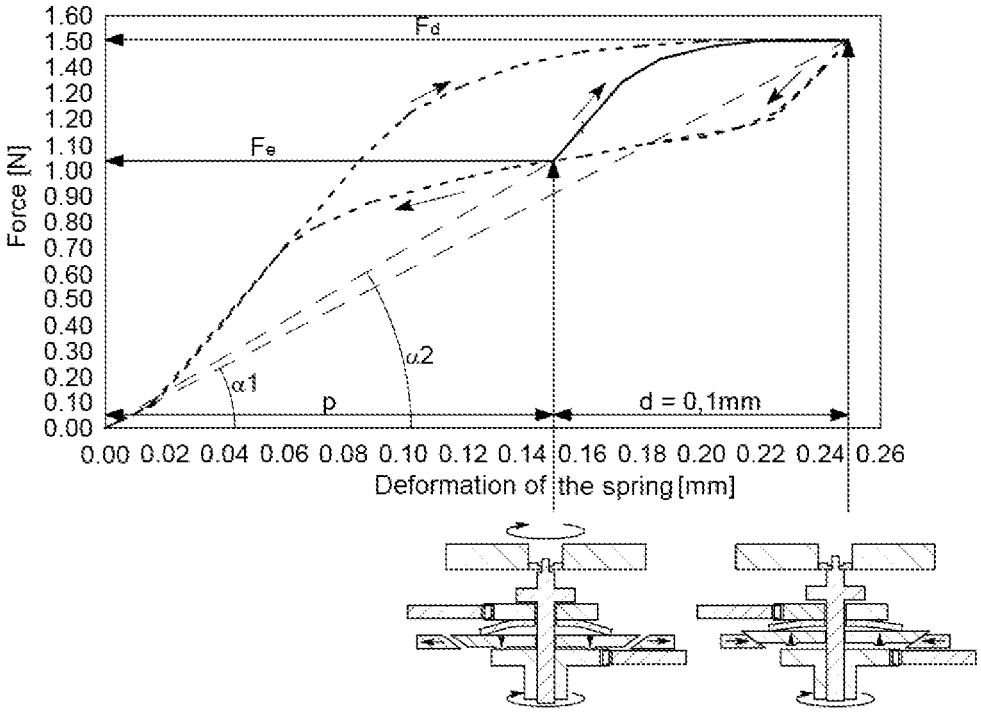
FIG. 6 shows the force-displacement curve for the spring having the mechanical properties of FIG. 4 and the geometry of FIGS. 5*a* and 5*b*.

Starting from the stress-deformation curve of the shape-memory alloy material, the dimensioning of the spring, namely the number of tabs, the active length of each tab and the section of the tabs will define the corresponding force-displacement curve of the spring made of this material as schematically shown in FIG. 6 for the dotted curve. In use, the spring is dimensioned to work with a disengaged force $F_d$ which is on the upper bearing of the hysteresis and with a clutched force $F_e$ which is on the lower bearing of the hysteresis. Note that the shape of the hysteresis can vary depending on the shade selected for the shape memory alloy. Thus, the force on the upper bearing and the lower bearing can be more or less constant depending on the selected shade.

The spring operates in a pre-stressed mode with the deformation of the spring, and advantageously of the tabs of the spring, which defines the clutched force $F_e$ on the lower bearing. The clutched force can thus be adjusted according to the pre-stress applied on the spring. As the material is superelastic, a significant pre-stress can be applied without the risk of plastically deforming the spring. Furthermore, the disengaged force $F_d$ can be adjusted according to the minimum displacement d required to avoid any contact between the clutch disc and the first wheel.

According to the invention, the ratio between the disengaged force and the clutched force is minimised and comprised between 1.1 and 2.0, preferably between 1.3 and 1.6. Expressed in absolute value, the vertical force $F_d$ is comprised between 1 and 3 N and the vertical force $F_e$ is comprised between 0.5 and 2 N, with $F_d$ greater than $F_e$, for a vertical displacement d between the clutched position and the disengaged position comprised between 0.05 and 0.3 mm. Another way to define the nonlinear superelastic behaviour of the spring in use is to characterise it according to its stiffness which is not constant during deformation. Thus, referring to FIG. 6, the slope of the straight line connecting the origin of the axes X-Y to the point ($F_e$, p) is greater than the slope of the straight line connecting the origin of the axes X-Y to the point ($F_d$, p+d). In other words, the angle $\alpha_2$ is greater than the angle $\alpha_1$.

Figure 4:
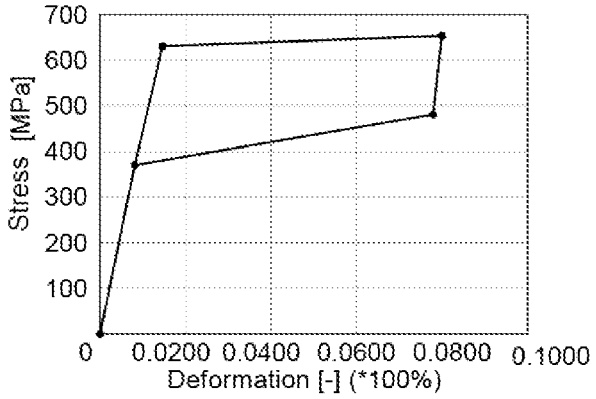
FIG. 4 shows the tensile curve of a shape memory Ni—Ti alloy used in the clutch device according to the invention.
Figure 5B:
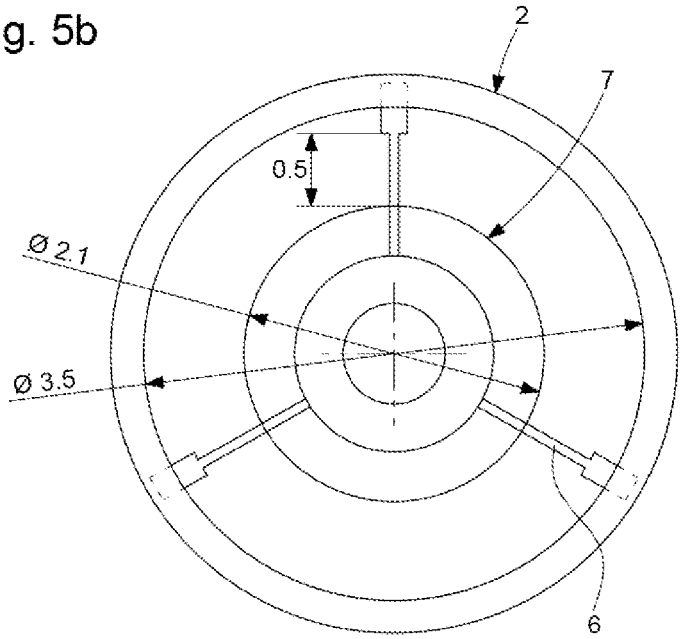
FIG. 5*b* shows using a plan view the respective dimensions of the second wheel, of the sleeve of the chronograph axis and the spring.

Finally, the present invention is illustrated using an example and FIGS. 4 to 6. FIG. 4 shows the mechanical properties of the shape memory nickel and titanium-based alloy with the above composition. FIG. 6 shows the corresponding force-displacement curve for a spring made of this alloy and having the dimensions given in FIG. 5*a*. This spring has a thickness of 0.2 mm and includes three tabs with a length of 0.85 mm for a width of 0.06 mm. After insertion between the sleeve 7 of the chronograph axis and the second wheel 2, the active length of each tab is approximately 0.5 mm (FIG. 5*b*).

Figure 2:
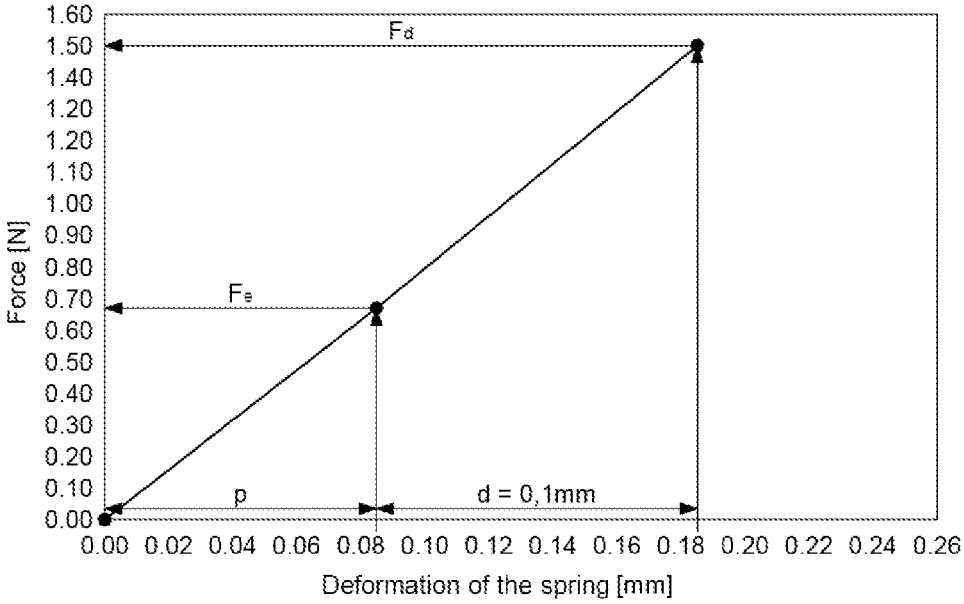
FIG. 2 shows the force-displacement curve for a standard alloy used in a clutch device according to the prior art.
Figure 2:
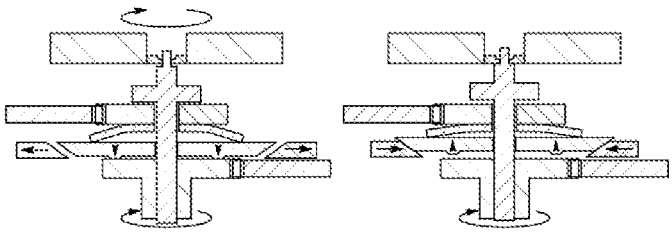

To be comparable to the operating conditions in FIG. 2, a disengaged force $F_d$ of 1.5 N was selected with the same disengagement stroke d of 0.1 mm. For these values $F_d$ and d, the clutched force $F_e$ could be maximised at 1.05 N, corresponding to a pre-stress distance p of 0.15 mm, compared to 0.67 N for a steel, which ensures that the clutch does not slip. Thus, it was possible to advantageously increase the clutched force without increasing the disengaged force while maintaining the same disengagement stroke. Consequently, the ratio of disengaged force to clutched force amounts to 1.4 compared to 2.2 for steel.

With a steel having a linear behaviour according to FIG. 2, increasing the clutched force up to 1.05 N would have required a significant pre-stress p on the spring with the corollary of a disengaged force clearly greater than 1.5 N, which would have led to a plastic deformation of the spring.

With reference to the curve in FIG. 6, it is also considerable to apply a pre-stress displacement p less than 0.15 mm, which for the same displacement d during disengagement, leads to a disengagement force less than 1.5 N.

LEGEND (1) Vertical clutch device
(2) Second mobile also called second wheel
(3) First mobile also called first wheel
(4) Clutch disc
(5) Clamp
(6) Spring
a. Central annular part
b. Tab
(7) Sleeve of the chronograph axis
(8) Chronograph mechanism
(9) Seconds wheel
(10) Chronograph wheel
(11) Watch or timepiece
(12) Vertical axis
(13) Jewel
(14) Central axis
$F_e$: clutched force
$F_d$: disengaged force
d: disengagement distance
p: displacement for pre-stressing the spring

The invention claimed is:

1. A vertical clutch device for a timepiece, comprising:
along a vertical axis a first wheel rotatably mounted about said vertical axis, a clutch disc, a spring, and a second wheel rotatably mounted about said vertical axis, said vertical clutch device being configured to assume a clutched position where the second wheel is rotated by the first wheel under the action of the spring exerting a vertical force Fe to press the clutch disc against the first wheel and a disengaged position where the clutch disc is subjected against the action of the spring to a vertical force Fd separating the clutch disc from the first wheel so that the second wheel is not rotated by the first wheel, wherein the spring of said vertical clutch device is made of a shape memory alloy,
wherein the vertical force Fd is comprised between 1 and 3 N and in that the vertical force Fe is comprised between 0.5 and 2 N for a vertical displacement d, between the clutched position and the disengaged position, comprised between 0.05 and 0.3 mm, said vertical force Fd being greater than said vertical force Fe.

2. The vertical clutch device according to claim 1, wherein the shape memory alloy is a copper-based alloy or a nickel and titanium-based alloy.

3. The vertical clutch device according to claim 2, wherein the copper-based alloy is one of the alloys having, for a total percentage of 100% and a percentage of possible impurities less than or equal to 0.5%, the following composition by weight:
Cu between 64.5 and 85%, Zn between 9.5 and 25% and Al between 4.5 and 10%,
Cu between 79.5 and 84%, Al between 12.5 and 14% and Ni between 2.5 and 6%,
Cu between 87 and 88%, Al between 11 and 12% and Be between 0.3 and 0.7%.

4. The vertical clutch device according to claim 2, wherein the shape memory alloy is a nickel and titanium-based alloy consisting, by weight, of nickel with a percentage comprised between 52.5 and 63% and of titanium with a percentage comprised between 36.5 and 47%, for a total percentage of 100% and a percentage of possible impurities less than or equal to 0.5%.

5. The vertical clutch device according to claim 1, wherein the shape memory alloy has an austenitic microstructure at room temperature giving the shape memory alloy superelastic properties at said room temperature.

6. The vertical clutch device according to claim 1, wherein the vertical clutch device is dimensioned to have in use a ratio between the vertical force Fd and the vertical force Fe comprised between 1.1 and 2.0.

7. The vertical clutch device according to claim 1, wherein the vertical clutch device is dimensioned to have in use a ratio between the vertical force Fd and the vertical force Fe comprised between 1.3 and 1.6.

8. The vertical clutch device according to claim 1, wherein the spring includes a central annular part and several tabs starting from said central annular part.

9. The vertical clutch device according to claim 1, wherein the thickness of the spring is between 0.05 and 0.4 mm.

10. The vertical clutch device according to claim 1, wherein, on a force-displacement curve of said spring, with the force defining the axis Y and the displacement defining the axis X, the angle $\alpha 2$, relative to the axis X of the straight line connecting the origin of the axes X-Y to the vertical force Fe, is greater than the angle $\alpha 1$ relative to the axis X of the straight line connecting the origin of the axes X-Y to the vertical force Fd.

11. A chronograph mechanism comprising:
the vertical clutch device according to claim 1.

12. A watch comprising:
the chronograph mechanism according to claim 11.

13. A vertical clutch device for a timepiece, comprising:
along a vertical axis a first wheel rotatably mounted about said vertical axis, a clutch disc, a spring, and a second wheel rotatably mounted about said vertical axis, said vertical clutch device being configured to assume a clutched position where the second wheel is rotated by the first wheel under the action of the spring exerting a vertical force Fe to press the clutch disc against the first wheel and a disengaged position where the clutch disc is subjected against the action of the spring to a vertical force Fd separating the clutch disc from the first wheel so that the second wheel is not rotated by the first wheel, wherein the spring of said vertical clutch device is made of a shape memory alloy,
wherein, on a force-displacement curve of said spring, with the force defining the axis Y and the displacement defining the axis X, the angle $\alpha 2$, relative to the axis X of the straight line connecting the origin of the axes X-Y to the vertical force Fe, is greater than the angle $\alpha 1$ relative to the axis X of the straight line connecting the origin of the axes X-Y to the vertical force Fd.

* * * * *